US007251433B2

(12) United States Patent
Ai et al.

(10) Patent No.: US 7,251,433 B2
(45) Date of Patent: Jul. 31, 2007

(54) IMAGE FORMING APPARATUS

(75) Inventors: Ryuta Ai, Toride (JP); Takehiro Kishi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/091,454

(22) Filed: Mar. 29, 2005

(65) Prior Publication Data

US 2005/0220478 A1 Oct. 6, 2005

(30) Foreign Application Priority Data

Mar. 31, 2004 (JP) ..... 2004-106345

(51) Int. Cl.
*G03G 15/16* (2006.01)

(52) U.S. Cl. ..... 399/101; 399/121

(58) Field of Classification Search ..... 399/91, 399/98, 99, 101, 107, 121
See application file for complete search history.

(56) References Cited

U.S. PATENT DOCUMENTS 5,101,238 A * 3/1992 Creveling et al. ..... 399/101
6,134,402 A * 10/2000 Nakayama et al. ..... 399/101
2005/0214021 A1* 9/2005 Friedrich et al. ..... 399/101

FOREIGN PATENT DOCUMENTS

JP 2001-356614 12/2001

* cited by examiner

*Primary Examiner*—Hoan Tran
(74) *Attorney, Agent, or Firm*—Fitzpatrick, Cella, Harper & Scinto

(57) ABSTRACT

An image forming apparatus includes an image bearing member, a transfer member, and a transfer member cleaning apparatus. The transfer member cleaning apparatus includes a cleaning blade and a rotatable cleaning member around the transfer member. A transfer member where a developer image is transferred from the image bearing member onto a transfer material, the cleaning blade, and the rotatable cleaning member are disposed in this order from an upstream side to a downstream side in a rotation direction of the transfer member. During a cleaning operation of the transfer member cleaning apparatus, developer in an amount corresponding to one to three layers of the developer passes through between the cleaning blade and the transfer member.

10 Claims, 2 Drawing Sheets

IMAGE FORMING APPARATUS

FIELD OF THE INVENTION AND RELATED ART

The present invention relates to an image forming apparatus, such as a copying machine, a printer, a facsimile apparatus, etc., provided with a cleaning apparatus for a transfer member by which a developer image is transferred from an image bearing member to a transfer(-receiving) material.

In a conventional image forming apparatus using an electrostatic process, a technique which meets near-photographic high image quality and near-printing machine speed enhancement has been required. In order to achieve the speed enhancement and high image quality, retainment of color stability, density uniformity, and the like is required. For that purpose, such a technique that a control image is formed at a non-image portion and a reflection density thereof or the like is detected and fed back to retain a stable image has been used widely.

The control image used in the technique must be removed (or cleaned) by any cleaning member during image formation so as not to be deposited on an image formation product obtained by an ordinary image forming method in the case where the control image is formed during a non-image formation period, particularly a sheet interval period. In order to effect cleaning of the surface of an image bearing member, such as a photosensitive member or an intermediary transfer member, on which an image is formed, developer (toner) for forming the image can be cleaned by a cleaning member provided for cleaning the photosensitive member or the intermediary transfer member applying a toner bias voltage of a polarity opposite to that during normal image formation at a transfer portion from the photosensitive member such as paper or the like or a transfer portion from the intermediary transfer member to the paper.

However, in a recent trend toward the speed-enhancement technology as described above, it has become very difficult to apply the bias voltage, opposite in polarity to that during the normal image formation, to the control image formed during the sheet interval period from the viewpoints of a time period and a length between consecutive two sheets.

In the case where it is difficult to apply the opposite bias voltage, the control image particularly during the image formation using the intermediary transfer member is transferred from the image bearing member to the intermediary transfer member and from the intermediary transfer member to a secondary transfer member. Particularly, in the case where there is no cleaning apparatus for the secondary transfer member, due to contamination of the secondary transfer member, a defective image attributable to back-side contamination, conveyance failure, or the like of the transfer material has been caused to occur.

Thus, it is necessary to use a transfer member cleaning apparatus for cleaning a high-density control image transferred onto the secondary transfer member. For this purpose, a blade-type cleaning apparatus having a high cleaning ability has been generally used widely. Further, as the secondary transfer member, one having a surface layer which is subjected to fluorine coating or the like is used so as to improve the cleaning ability of the blade-type transfer apparatus, thus stabilizing blade travelling (moving) property.

However, as the secondary transfer member, in many cases, a surface-roughed secondary transfer member is used from the viewpoint of paper conveyance performance. In these cases, low-concentration toner, deposited at the non-image formation portion in a developing step, such as development fog toner or the like, can be cleaned by the blade-type cleaning apparatus. However, in order to completely clean a high-density image such as the control image or the like, it is necessary to increase an abutment pressure or an abutment angle of the blade, i.e., a linear pressure at a nip (portion) of the blade.

However, both of the secondary transfer member and the cleaning blade are an elastic member, thus providing a large frictional force. As a result, when the linear pressure at the blade nip is increased, there has arisen such a problem that turning up of the cleaning blade is liable to occur.

For this reason, in order to effect cleaning of a surface-roughened secondary transfer member, there has been proposed an electrostatic cleaning method which has less constraint on a surface shape of a member to be subjected to cleaning compared with the above described blade method. More specifically, electrostatic fur brush cleaning is ordinarily used as described in Japanese Laid-Open Patent Application No. 2001-356614.

The electrostatic fur brush cleaning is such a cleaning method that temperature on a secondary transfer member is transferred onto an electroconductive fur brush by applying a bias voltage of a polarity opposite to that of the transfer to the fur brush, thus effecting cleaning. According to this cleaning method, even in the case of the surface-roughened secondary transfer member, a pointed bristle of the fur brush enters a roughened portion on the surface of the secondary transfer member, so that good cleaning can be advantageous effected.

However, the electrostatic fur brush cleaning has less constraint on the surface shape of the member subjected to cleaning but is effected electrostatically, so that a cleaning performance thereof is inferior to the blade method. As a result, it is difficult to completely remove high-concentration transfer. For this reason, due to accumulation of a slight amount of transfer passing through the fur brush, the surface layer of the secondary transfer member is contaminated with the transfer. As a result, the contaminant (transfer) is transferred onto the transfer material such as paper or the like, thus causing occurrences of back-side contamination of the transfer material and image defect at the time of double-sided copying.

SUMMARY OF THE INVENTION

An object of the present invention is to provide an image forming apparatus having solved the above described problems.

A specific object of the present invention is to provide an image forming apparatus which includes a transfer member, for transferring developer image from an image bearing member to a transfer material, supplied with a transfer bias voltage and is capable of completely removing high-concentration temperature to be transferred onto the transfer member to prevent occurrences of back-side contamination and image defect at the time of contamination and image defect at the time of double-sided printing on the transfer material.

According to an aspect of the present invention, there is provided an image forming apparatus, comprising:

an image bearing member on which a developer image is formed with developer, a transfer member which is a rotatable member and transfers the developer image from the image bearing member onto a transfer material, and a transfer member cleaning apparatus for effecting a cleaning operation for removing developer deposited on the transfer member, wherein the transfer member cleaning apparatus comprises, around the transfer member, a cleaning blade and a rotatable cleaning member which is a rotatable member; and a transfer position at which the developer image is transferred from the image bearing member onto the transfer material, the cleaning blade, and the rotatable cleaning member are disposed in this order from an upstream side to a downstream side in a rotation direction of the transfer member, and wherein during a cleaning operation of the transfer member cleaning apparatus, developer in an amount corresponding to one to three layers thereof passes through between said cleaning blade and said transfer member.

In an embodiment of the present invention, during the cleaning operation of the transfer member cleaning apparatus, the cleaning blade leaves the developer in a first amount corresponding to one to three layers of the developer on the transfer member and removes developer in a second amount exceeding the first amount, and thereafter the rotatable cleaning member removes the developer left on the transfer member. The rotatable cleaning member may preferably be a fur brush.

In another embodiment of the present invention, the rotatable cleaning member comprises an electroconductive member and is supplied with a bias voltage of a polarity opposite to that of the developer during the cleaning operation of the transfer member cleaning apparatus. The rotatable cleaning member may preferably contact an electroconductive roller which contacts a blade and is supplied with a bias voltage of a polarity opposite to that of the developer. The rotatable cleaning member may be supplied with the bias voltage of a polarity opposite to that of the developer through the electroconductive roller.

In another embodiment of the present invention, the transfer member comprises an elastic member having a surface coating layer which has a surface roughness Rz satisfying 1.5 micron<Rz<10 microns.

In another embodiment of the present invention, the cleaning blade abuts against the transfer member in a direction opposite from the rotation direction of the transfer member at an abutment angle of 5-20 degrees and an abutment pressure of 15-30 g/cm.

In another embodiment of the present invention, the developer has an average particle size of 5-6 microns.

In another embodiment of the present invention, the image bearing member is a second image bearing member onto which the developer image is transferred from a first image bearing member.

As described above, the image forming apparatus of the present invention includes the image bearing member on which a developer image is formed with developer, the transfer member which is a rotatable member and transfers the developer image from the image bearing member onto a transfer material, and the transfer member cleaning apparatus for effecting a cleaning operation for removing developer deposited on the transfer member.

The transfer member cleaning apparatus comprises, around the transfer member, a cleaning blade and a rotatable cleaning member which is a rotatable member. In the image forming apparatus, a transfer position at which the developer image is transferred from the image bearing member onto the transfer material, the cleaning blade, and the rotatable cleaning member are disposed in this order from an upstream side to a downstream side in a rotation direction of the transfer member. In the image forming apparatus, during a cleaning operation of the transfer member cleaning apparatus, developer in an amount corresponding to one to three layers thereof passes through between the cleaning blade and the transfer member. As a result, even when high-concentration developer is transferred onto the transfer member, the image forming apparatus of the present invention can completely remove the developer from the transfer member, thus obviating occurrence of bake-side contamination of paper as the transfer member and image defect at the time when the image forming apparatus is subjected to double-sided printing.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the image forming apparatus according to the present invention will be described more specifically with reference to the drawings.

As an embodiment of the image forming apparatus of the present invention, in this embodiment, an electrophotographic- and tandem-type image forming apparatus provided with four photosensitive members 101 as a first image bearing member is used.

Figure 1:
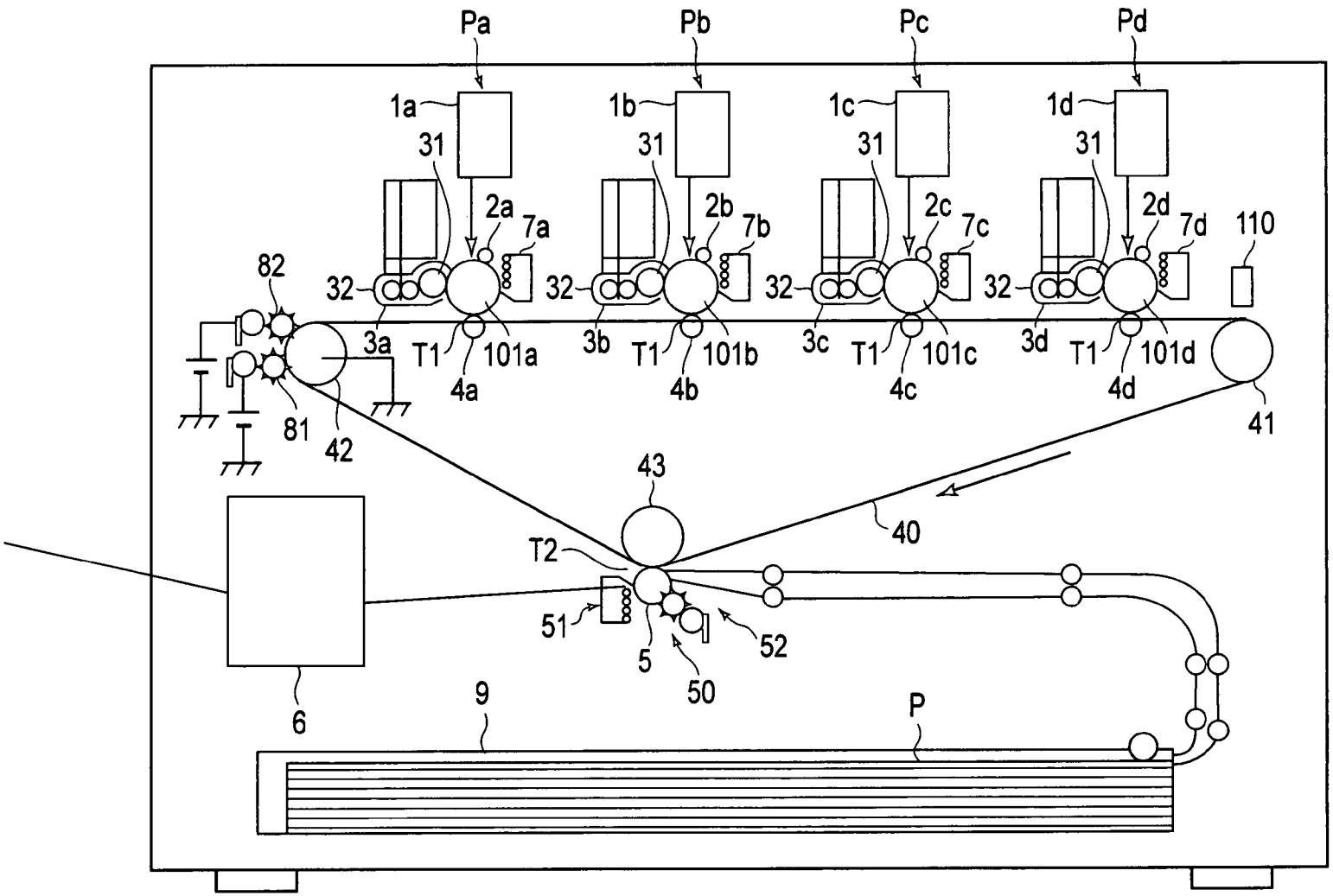
FIG. 1 is a schematic view showing an embodiment of the image forming apparatus according to the present invention.

As shown in FIG. 1, the image forming apparatus is also constituted as an intermediary transfer-type image forming apparatus provided with an endless belt-like intermediary transfer member (intermediary transfer belt) 40 as a secondary image bearing member.

Referring to FIG. 1, the intermediary transfer belt 40 is supported by and extended around a drive roller 41, a tension roller 42, and a backup roller 43. Along a horizontal portion, between the drive roller 41 and the tension roller 42, of the intermediary transfer belt 40 having elasticity, four image forming portions Pa, Pb, Pc and Pd which have the same structure and are integrally disposed with associated image forming means acting on an associated photosensitive member 101, are linearly disposed. The structure of the image forming portions Pa to Pd will be described while taking the image forming portion Pa as an example.

The image forming portion Pa includes a drum-like electrophotographic photosensitive member (photosensitive drum) 101*a* which is rotatably disposed as the first image bearing member. Around the periphery of the photosensitive drum 101*a*, process equipment comprising image forming means constituted by a primary charger 2*a*, an exposure apparatus 1*a*, a developing apparatus (device) 3*a*, a cleaning apparatus 7*a*, and the like, are disposed. Similarly, other image forming portions Pb, Pc and Pd include: respective photosensitive drums 101*b*, 101*c* and 101*d*; primary chargers 2*b*, 2*c* and 2*d*; exposure apparatuses 1*b*, 1*c* and id; developing devices 3*b*, 3*c* and 3*d*; and cleaning apparatuses 7*b*, 7*c* and 7*d*. The image forming portions Pa, Pb, Pc and Pd are different from each other in that they are used for forming developer (toner) images of yellow, magenta, cyan and black, respectively.

In the developing devices (3*a*, 3*b*, 3*c*, 3*d*) disposed at the respective image forming portions Pa to Pd, respectively, yellow toner, magenta toner, cyan toner, and black toner are contained, respectively, as developer.

The photosensitive drum 101*a* is electrically charged uniformly by the primary charger 2*a* in a charging step, and then in a latent image forming step (exposure step), an image signal for a magenta component of an original is projected on the photosensitive drum 101*a* through a polygon mirror or the like to form an electrostatic latent image. Then, in a developing step, the yellow toner is supplied from the developing device 3*a* to the electrostatic latent image formed on the photosensitive drum 101*a* to develop the electrostatic latent image as an yellow toner image.

The yellow toner image, when reaches a primary transfer portion T1 where the photosensitive drum 101*a* and the intermediary transfer belt 40 abut against each other by the rotation of the photosensitive drum 101*a* in a horizontal plane through which the intermediary transfer belt 40 and the respective image forming portions Pa to Pd are located opposite to each other, is supplied with a primary transfer bias voltage from a transfer roller 4*a* as a primary transfer member (first transfer means), thus being primary-transferred onto the surface of the intermediary transfer belt 40. When the intermediary transfer belt 40 carrying thereon the yellow toner image conveys an yellow toner carrying portion by its rotation to a subsequent image forming portion Pb, a magenta image which has been formed on the photosensitive drum 101*b* in the same manner as described above before the timing of conveyance of the yellow toner image carrying portion is transferred onto the yellow toner image. Similarly, with movement of the image carrying portion to the image forming portions Pc and Pd by the rotation of the intermediary transfer belt 40 in a direction of an arrow, a cyan toner image and a black toner image are successively transferred onto the yellow and magenta toner images in a superposition manner at the respective transfer portions T1.

Before that timing, a transfer material P fed from a paper feeding cassette 9 reaches a secondary transfer portion T2. In a secondary transfer step, the above formed four-color toner image is transferred onto the transfer material P by applying a secondary transfer bias voltage to a secondary transfer member 5 as a second transfer means.

The transfer material P onto which the toner image is transferred is conveyed to a fixation portion 6. In a fixation step, the toner image is fixed on the transfer material P under heat and pressure by the transfer portion 6.

Transfer residual toner, remaining on the photosensitive drums 101 (101*a* to 101*d*), which has not been transferred by the primary transfer members 4 (4*a* to 4*d*) is removed (cleaned) by the cleaning apparatuses 7 (7*a* to 7*d*) provided at the respective image forming portions Pa to Pd.

Further, transfer residual toner, remaining on the intermediary transfer belt 40, which has not been transferred by the secondary transfer member 5 is removed by a first intermediary transfer belt cleaning apparatus 81 and a second intermediary transfer belt cleaning apparatus 82. The intermediary transfer belt 40 after the cleaning is subjected to subsequent image formation.

Here, constitutions of the respective image forming means in this embodiment will be described more specifically. However, the present invention is not limited thereto.

The photosensitive drum 101 as the image bearing member is constituted by applying a layer of organic photoconductor (OPC) to an outer peripheral surface of an aluminum cylinder having a diameter of 80 mm. The photosensitive drum 101 is rotatably supported by flanges at both end portions thereof and is rotationally driven in a counterclockwise direction in FIG. 1 by transmitting a driving force from an unshown drive motor to one of the end portions of the photosensitive drum 101.

Each of the primary charges 2 (2*a* to 2*d*) is formed in a roller shape to constitute an electroconductive roller. This roller is caused to abut against the surface of the photosensitive drum 101 and is supplied with a charging bias voltage by an unshown power source, whereby the surface of the photosensitive drum 101 is negatively charged uniformly.

Each of the exposure apparatuses (1*a* to 1*d*) as the exposure means is constituted by an LED array provided with an unshown polygon mirror at its end portion and is light-controlled by an unshown drive circuit depending on an image signal.

Each of the developing devices 3 (3*a* to 3*d*) is constituted by, e.g., an unshown toner containing portion 32 for containing a negatively chargeable (color) toner of yellow, magenta, cyan or black and a developing roller 31 as a developer carrying member which is disposed in the toner containing portion 32 at a position adjacent to the photosensitive drum 101 surface and collects toner from the toner containing portion 32 and supplied with a developing bias voltage by an unshown developing bias power source so as to carry the toner at its peripheral surface and convey the toner to the surface of the photosensitive drum 101, thus effecting development. The developing devices 3 (3*a* to 3*d*) containing the yellow toner, the magenta toner, the cyan toner, and the black toner at the image forming portions Pa to Pd, respectively, are disposed in this order from an upstream side of a movement direction of the intermediary transfer belt 40.

The intermediary transfer belt 40 has a peripheral length of 2400 mm and is rotated at a rotation speed of 300 mm/sec by the rotation of the stretching rollers 41, 42 and 43. INside the intermediary transfer belt 40, four transfer rollers 4 (4*a* to 4*d*) as the primary transfer member are disposed in contact with the intermediary transfer belt 40 while being opposite to the associated four photosensitive drums 101 (101*a* to 101*d*), respectively. These transfer rollers 4 (4*a* to 4*d*) are electrically connected with an unshown transfer bias voltage power source and each of the transfer rollers applies a positive-polarity voltage to the associated photosensitive drum 101 to successively transfer the negatively charged toner image formed on the photosensitive drum 101 onto the intermediary transfer belt 40 in contact with the photosensitive drum 101, thus forming a color image.

The color image carried on the intermediary transfer belt 40 at the primary transfer portion T1 is further transferred onto the transfer material P by the secondary transfer roller 5 as the secondary transfer member which abuts against the intermediary transfer belt 40. The secondary transfer roller 5 is electrically connected with an unshown transfer bias power source and applies a positive-polarity voltage to the intermediary transfer belt 40 to successively transfer the negatively charged toner image carried on the intermediary transfer belt 40 onto the transfer material P in contact with the intermediary transfer belt 40, thus forming a color image. The secondary transfer roller 5 is constituted by two or more layers including an elastic rubber layer and a coating layer. The elastic rubber layer comprises a foam layer which has a cell diameter of 0.05-1.0 mm and contain carbon black in a dispersion state. The coating layer as a surface layer is a 0.1-1.0 mm-thick layer of a fluorine-containing resin material and contains an ion-conductive polymer in a dispersion state. The coating layer is controlled to have a surface roughness Rz satisfying: Rz>1.5 microns.

As the fluorine-containing resin material, it is possible to use tetrafluoroethylene (TFE) resin, hexafluoropropylene (FEP) copolymer, perfluoroalkoxy (PFA) resin, polyvinylidene difluoride (PVDF), etc.

As the ion-conductive polymer used as an electroconductive agent, it is possible to use polymers including: various copolymers of, e.g., styrene with (meth-)acrylate obtained by connecting carboxyl group with quaternary ammonium base; a polymer containing quaternary ammonium base, such as a copolymer of methacrylate with maleimide connected to quaternary ammonium base; a polymer containing alkali metal salt (e.g., sodium) of sulfonic acid, such as sodium polysulfonate; and polymers containing at least a hydrophilic unit of alkylene oxide in a molecular chain, such as polyethylene oxide, polyethylene glycol-polyamide copolymer, polyethylene-epichlorohydrin copolymer, polyetheramide imide, and a block polymer containing polyether as a segment.

By using the ion-conductive polymer as the electroconductive agent dispersed in the coating layer of the secondary transfer roller 5, a change in electric resistance by the transfer (bias) voltage is small compared with the case of using carbon black singly. Further, the fluorine-containing resin material having low surface energy is principally used. As a result, it is possible to cause the cleaning blade of the secondary transfer member cleaning apparatus described later to stably abut against the secondary transfer roller 5, so that it becomes possible to obviate problems of turning up of the cleaning blade, jitter, etc.

By providing the coating layer at the surface of the secondary transfer roller 5, it is possible to stabilize the abutment state of the cleaning blade. Further, it becomes possible to stabilize paper conveyance by using the surface layer which has been uniformly roughened.

The image forming apparatus of this embodiment performs the above described image forming steps to effect ordinary image formation by which a desired image is formed on the transfer material such as paper, etc. In addition thereto, the image forming apparatus also performs patch detection control such that a predetermined test pattern, called a patch, as a control image is formed on the intermediary transfer belt in order to always suitably provide a desired image obtained through the ordinary image formation and on the basis of measurement results of physical properties such as density, chromaticity, or the like of the test pattern, an unshown control means of the image forming apparatus effect settings of various image forming conditions of the image forming means for performing the above described image forming steps. More specifically, the control means sets suitable image forming conditions by adjusting an exposure light intensity of the exposure apparatuses 3, values of the developing bias voltage, and a valves of the charging bias voltage applied to the primary chargers 2, and controls amounts of toner supplied to the developing devices 2.

In this embodiment, as the patch detection control, maximum image density control is carried out.

In the maximum image density control, in order to respond to a change in characteristic of the toner due to a change in durability or environmental condition, an image forming condition for obtaining an appropriate density is changed by forming a patch periodically at a maximum image density in a period of pre-rotation for the ordinary image formation or a period of sheet (paper) feeding interval for continuous image formation on a large number of sheets and detecting an output value of the image density. BY doing so, it is possible to set the image forming condition depending on an environment at any given time.

In other words, the maximum image density control is carried out at the times when the apparatus environment is abruptly changed, when an initial image density is set by developer contained in the developing device 3, and when the operation of the image forming apparatus is restarted after external supply or replacement of developer (container) is completed. As a result, it is possible to effect image control so as to provide an appropriate image density in all the environments by performing the ordinary image formation under the image forming condition determined by the above described maximum image density control.

In the apparatus control means, at the time of controlling the maximum image density, data on a solid image at the maximum image density are stored as a test pattern providing a patch. On the basis of a resultant image signal, a patch latent image is formed on the photosensitive drum 101 which has already been electrically charged by the primary charger 2 by effecting the exposure with the exposure apparatus 1 so as to provide a maximum image density and is developed with the toner contained in the developing device 3 to provide the above described patch. The patch is transferred and formed onto the intermediary transfer belt 40. The patch on the intermediary transfer belt 40 is irradiated with light by a density detection sensor 110 as an optical sensor disposed at a position where the sensor is opposite to a portion of the intermediary transfer belt 40 extended and stretched by drive roller 41 as shown in FIG. 1. From a magnitude of reflected light at that time, an image density is determined. A relationship between the image density and the image forming condition are optimized from the determined image density and the image forming conditions, such as the exposure light intensity of the exposure apparatus 3, the developing bias voltage value, the primary transfer bias voltage value, etc., thus adjusting the image forming condition so as to always provide an image having an appropriate image density.

As the patch detection control, there are various control methods other than the above described maximum image density control. Examples thereof may include control of changing an exposure angle or the like of the exposure apparatus 1 by detecting color deviation of patches for respective colors formed on the intermediary transfer belt 40 with a color deviation sensor; in the case of a two-component developing apparatus including the developing device containing developer, toner supply control wherein a solid image patch set to have a predetermined density is formed on the intermediary transfer belt 40 and a lowering in density is detected to supply toner to the developing device 3; and patch control wherein a gradation image as a patch is formed and its chromaticity and density are measured by a color sensor to effect gradation control. Further, in addition to these patch detection controls, it is also possible to discharge toner from the developing device 3 to be transferred onto the intermediary transfer belt 40 in order to refresh the toner in the developing device 3.

In this embodiment, during the patch detection control, the solid image is formed as the patch at the maximum image density. This patch is recovered by the intermediary transfer belt cleaning apparatuses 81 and 82 in the case where the patch detection control described above is performed at a time other than the time when the ordinary image forming process is performed, such as the case of the time when the image forming apparatus is started up or the user designates the patch as a test mode. At this time, the patch is not transferred onto the secondary transfer roller 5 by not applying a bias voltage to the secondary transfer roller 5 or by applying thereto a bias voltage of a polarity opposite to that at the time of ordinary image formation.

However, in the case where the patch detection control is carried out during the pre-rotation of the image forming step or a period of sheet interval, in this embodiment, the operation of switching the polarity of bias voltage applied to the secondary transfer roller 5 is not performed in order to enhance the speed.

In other words, the high-density patch is transferred to the secondary transfer roller 5 and subjected to cleaning by the transfer member cleaning apparatus 50 for the secondary transfer roller 5.

Figure 2:
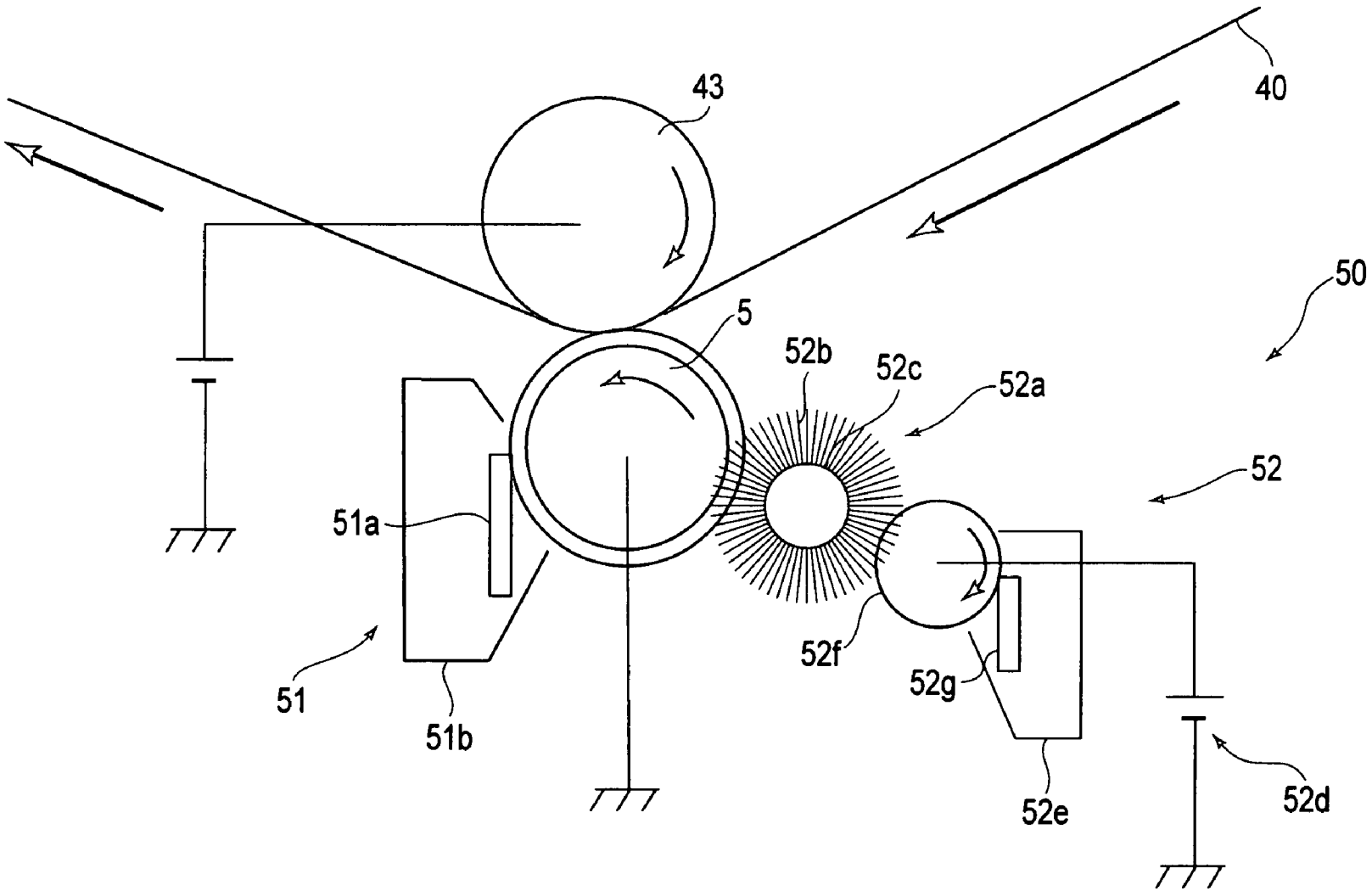
FIG. 2 is a schematic view showing an embodiment of a transfer member and an embodiment of a transfer member cleaning apparatus used in the image forming apparatus of the present invention.

In this embodiment, the transfer member cleaning apparatus 50 is, as specifically shown in FIG. 2, provided with a blade cleaning apparatus 51 having a cleaning blade 51*a* which exhibits a high cleaning performance. The cleaning blade 51*a* is a blade-like member abutting against the secondary transfer roller 5 in a direction opposite from the rotation direction of the secondary transfer roller 5, and the toner removed by the cleaning blade 51*a* is recovered in a cleaning container 51*b*. However, as described above, the secondary transfer roller 5 may desirably has a surface layer which is roughened to some extent from the viewpoint of sheet (paper) conveyance performance. For this reason, even when the surface layer is formed of a fluorine-containing resin material having low surface energy to ensure stability of the cleaning blade 51*a*, it is difficult to completely remove the above described high-density patch.

For this reason, in order to recover the toner passing through between the cleaning blade 51*b* and the secondary transfer roller 5 without so increasing a linear pressure of the cleaning blade 51*b* with respect to the secondary transfer roller 5, a fur brush cleaning apparatus 52 is disposed downstream from the cleaning blade 51*b* in the rotation direction of the secondary transfer roller 5.

In the cleaning apparatus 50 for the secondary transfer roller 5, the electrostatic fur brush cleaning described with respect to the conventional cleaning method is carried out. More specifically, as the transfer member cleaning apparatus 50, the fur brush cleaning apparatus 52 having the fur brush 52*a* as an electroconductive rotatable cleaning member constituted by a roller 52*c* provided with a brush portion 52*b* at its peripheral surface. The brush portion 52*b* of the fur brush 52*a* is caused to contact the peripheral surface of the secondary transfer roller 5 and the fur brush 52*a* is rotated in a direction opposite from the rotation direction of the secondary transfer roller 5. Then, a bias voltage of a polarity opposite to that of the toner is applied from a power source 52*d* to a roller portion 52*c* of the fur brush 52*a* through a metal roller 52*f* described later. As a result, the toner deposited on the secondary transfer roller 5 is transferred onto the fur brush 51*a*. The toner removed by the fur brush 52*a* is recovered in a recovery container 52*e* according to a method described later were specifically.

Incidentally, as the rotatably cleaning member, the fur brush may preferably be used but roller members of other kinds may also be effective.

In this embodiment, the cleaning blade 51*a* contacting the secondary transfer roller 5 is a 2 mm-thick blade-like member and abuts against the secondary transfer roller 5 in a direction opposite from the rotation direction of the secondary transfer roller 5. The abutment angle may desirably be in the range of 5-25 degrees in order to prevent turning up of the cleaning blade 51*a* and uniformly decrease and cause the toner to pass through the cleaning blade 51*b* and the secondary transfer roller 5. Further, the abutment pressure of the cleaning blade 51*a* may preferably be in the range of 15-30 g/cm.

Further, the fur brush 52*a* disposed downstream from the cleaning blade 51*a* in the rotation direction of the secondary transfer roller 5 has an outer diameter of 18 mm, and the brush portion 52*b* has a length of 4 mm, an entering amount to the secondary transfer roller 5 of 1.0 mm, a density of 50 kF/inch$^2$, and an electric resistance of $10^6$ ohm. The fur brush 52*a* is rotated in a direction opposite from the rotation direction of the secondary transfer roller 5 at a speed of 20% of the peripheral speed of the secondary transfer roller 5. The fur brush 52*a* is supplied with a bias voltage of +500 V from the power source 52*d* through the metal roller 52*f*.

The electroconductive roller, i.e., the metal roller 52*f* in this embodiment contacts the fur brush 52*a* and has an outer diameter of 15 mm. The metal roller 52*f* is caused to abut against the fur brush 52*a* as a bias roller in an entering amount of 1.5 mm and is supplied with a bias voltage of +500 V from the power source 52*d*. As a result, a difference in potential is generated between the metal roller 52*f* and the fur brush 52*a* is further transferred onto the metal roller 52*f* by the potential difference between the metal roller 52*f* and the fur brush 52*a*, and then is removed by a (roller) blade 52*g* for the metal roller 52*f*, which is an elastic plate-like member, thus being recovered in the recovery container 52*e*.

As described above, in the fur brush cleaning apparatus 52, the metal roller 52*f* on which the roller blade 52*g* abuts is in contact with the fur brush 52*a* and the bias voltage is applied to the fur brush 52*a* through the metal roller 52*f* to create the potential difference between the fur brush 52*a* and the metal roller 52*f* due to the electric resistance value of the fur brush 52*a*. As a result, the toner electrostatically adsorbed (transferred) from the secondary transfer roller 5 to the fur brush 52*a* is transferred onto the metal roller 52*f* by the potential difference. The toner transferred onto the metal roller 52*f* is removed by the roller blade 52*g* abutting against the metal roller 52*f*, thus being prevented from remaining on the fur brush 52*a*.

Here, as described in the conventional cleaning method, the fur brush 52*a* has an upper limit of the cleaning performance. For this reason, it is necessary to effect setting of the cleaning blade 51*a* so that an amount of the high-concentration toner which has passed through the cleaning blade 51*b* and the secondary transfer roller 5 does not exceed that corresponding to the upper limit of the cleaning performance of the fur brush 52*a*.

In order to determining the setting condition, a continuous image formation test on $10\times10^4$ sheets was performed under six conditions (Experimental Embodiments 1 to 6) wherein image formation by the above described image forming apparatus was effected by changing a surface roughness Rz of the secondary transfer roller 5, the abutment angle of the cleaning blade 51*a*, and the abutment pressure of the cleaning blade 51*a* to evaluate the number of layers of toner corresponding to an elementary quantity of the toner passing through the cleaning blade 51*b* and the secondary transfer roller 5, a state of turning up of the cleaning blade 51*a*, a state of abrasion of the secondary transfer roller 5, a state of turning up of the roller blade 52*g*, and a state of back-side contamination/image failure during double-sided printing.

The results are shown in Table 1 appearing hereinafter.

Incidentally, a patch is formed at every two-sheet interval as a square toner image of 5 cm×5 cm at a toner concentration of 0.7 mg/cm$^2$ corresponding to 5 toner layers.

The number of toner layers represents an amount of toner passing through the cleaning blade 51*b* and the secondary transfer roller 5 and is the number of layers of toner on the assumption that the transfer of the patch formed on an image bearing member is placed in a closest packing state. For example, the toner layer number at the time when the toner is placed in the closest packing state can be obtained from height data of toner layer(s) and toner particle size which are measured by an ultradeep shape measurement microscope ("VK-8550", mfd. by Keyence Corp.), thus determining the amount of toner passing through the cleaning blade 51*b* and the secondary transfer roller 5.

TABLE 1

| | Condition | | | Results | | | | |
|---|---|---|---|---|---|---|---|---|
| Emb. | *1 Rz | *2 AA | *3 AP | *4 TLN | *5 IF | *6 CBT | *7 RA | *8 RBT |
| 1 | 1.0 | 25 | 30 | 0 | NO | YES | YES | YES |
| 2 | 1.0 | 20 | 20 | 0 | NO | YES | YES | YES |
| 3 | 2.0 | 25 | 35 | 2 | NO | YES | NO | NO |
| 4 | 2.0 | 20 | 20 | 2 | NO | NO | NO | NO |
| 5 | 2.0 | 5 | 10 | 5 | YES | NO | NO | NO |
| 6 | 13 | 20 | 20 | 5 | YES | NO | NO | NO |

*1: "Rz" is a surface roughness (μm) of the secondary transfer roller 5.
*2: "AA" is an abutment angle (degrees) of the cleaning blade 51a.
*3: "AP" is an abutment pressure (g/cm) of the cleaning blade 51a.
*4: "TLN" is the number of toner layers corresponding to the amount of toner passing through the cleaning blade 51b and the secondary transfer roller 5.
*5: "IF" is back-side contamination/image failure during double-sided printing.
*6: "CBT" is turning up of the cleaning blade 51a.
*7: "RA" is abrasion of the secondary transfer roller 5.
*8: "RBT" is turning up of the roller blade 52 g.
YES: "YES" represent that the phenomenon occurred.
NO: "NO" represents that the phenomenon did not occur.

As shown in Table 1, in Experimental Embodiments 1 and 2 wherein the surface roughness Rz of the secondary transfer roller 5 is small, i.e., 1 micron, the number of toner layers is (passing through the cleaning blade 51*b* and the secondary transfer roller 5) is 0, so that the high-concentration toner can be removed well. However, as a result, the external additive remaining on the secondary transfer roller 5 is lost, thus causing the turning up of the cleaning blade 51*a*, the abrasion of the secondary transfer roller 5 due to a large frictional force between the fur brush 52*a* and the secondary transfer roller 5, and the turning up of the roller blade 52*g* abutting against the metal roller 52*f*.

With respect to Experimental Embodiments 3, 4 and 5 wherein the surface roughness of the secondary transfer roller 5 is 2 microns, in Experimental Embodiment 4 wherein the abutment angle and pressure of the cleaning blade 51*a* are in the above described set range of 5-25 degrees and 15-30 g/cm, the number of toner layers is stabilized as two (layers). As a result, there are no occurrences of the turning up of the cleaning blade 51*a*, the turning up of the roller blade 52*g*, the abrasion of the secondary transfer roller 5, etc. However, in Experimental Embodiment 3 wherein the abutment pressure is 35 g/cm out of the above described range, the turning up of the cleaning blade 51*a* is caused to occur even when the number of toner layer is 2. Further, in Experimental Embodiment 5 wherein the abutment pressure if 10 g/cm, the number of toner layer is 5, so that backside contamination of paper is caused to occur.

In Experimental Embodiment 6 wherein the surface roughness of the secondary transfer roller 5 is 13 microns, the number of toner layers is 5, i.e., 7 microns in thickness even when the settings of the cleaning blade 51*b* are within the set ranges in the present invention, so that the back-side contamination of paper is caused to occur.

From the above results, it has been found that the disadvantages such as the occurrences of the back-side contamination of paper and the abrasion of the secondary transfer roller 5 are less liable to occur when the number of toner layer passing through the cleaning blade 51*b* and the secondary transfer roller 5 is 2. Further, the cleaning of the secondary transfer roller 5 is also performed well by appropriately setting the abutment angle and pressure of the cleaning blade 51*a*. As a result, it has been clarified that it is possible to prevent the abrasion of the respective members.

Accordingly, at least the cleaning blade and the fur brush are disposed so that the cleaning blade is located upstream from the fur brush in the secondary transfer roller rotation direction, and the cleaning blade is set so that the number of toner layers passing through the cleaning blade and the secondary transfer roller is 1 to 3 so as to permit stable passage of toner in an appropriate amount through the cleaning blade and the secondary transfer roller. As a result, the amount of toner of high-density control image to be cleaned (removed) by the fur brush is reduced to that corresponding to 1 to 3 layers of toner. In addition, by the frictional force acting on the secondary transfer roller at the cleaning blade edge portion, it is possible to separate the toner and particles which is called additives, such as chargeability-imparting agent, flowability-imparting agent, and the like, from each other.

When the number of toner layers passing through the cleaning blade and the secondary transfer roller is 1 to 3, the fur brush disposed in contact with the secondary transfer roller is capable of completely removing the high-concentration toner transferred onto the secondary transfer roller because the toner amount corresponding to the toner layer number (of 1 to 3) is not more than an amount permitting cleaning of the toner by the fur brush. When the number of toner layers exceeds 3, the toner transferred onto the fur brush is again deposited on the secondary transfer roller, thus causing the back-side contamination of the paper, etc.

The fur brush is supplied with a certain amount of toner, so that the toner is always deposited on the fur brush to reduce the frictional force between the fur brush and the secondary transfer roller, thus alleviating the occurrence of abrasion of the secondary transfer roller by the friction of the secondary transfer roller with the brush portion of the fur brush.

Further, by the cleaning blade, the toner reduced in an amount corresponding to 1 to 3 layers is separated into toner and external additives. The external additives have a particle size of not more than 100 nm and such a charging characteristic that electric charge is substantially zero, so that it is difficult to carry cut the cleaning with the fur brush supplied with the bias voltage. As a result, only the toner is removed (cleaned) by the fur brush. Accordingly, the toner on the secondary transfer roller after passing through the fur brush is completely removed but the external additives can always remain on the secondary transfer roller, thus achieving an effect of lubricant on the cleaning blade. As a result, the turning up of the cleaning blade can be prevented. In this embodiment, the toner has an average particle size of 5-6 microns, preferably 5.3-5.7 microns, so that it is possible to pass the toner through the cleaning blade and the secondary transfer roller in such an amount as to correspond to 1 to 3 layers of toner.

Incidentally, the particle size of the toner means a weight-average particle size as measured by a Coulter counter TA-II or a Coulter multisizer (available from Coulter Electronics Inc.). As an electrolytic solution, 1% NaCl solution of an extra pure reagent sodium hydrochloride is used. In 100-150 ml of the electrolytic solution, 0.1-5 ml of a surfactant, preferably alkylbenzene sulfonic acid salt is added as a dispersing agent and 2-20 mg of a measuring sample is further added, followed by dispersion for about 1-3 minutes in an ultrasonic dispersing device. The dispersion is subjected to measurement of particle size distribution by the above measurement apparatus with a 100 microns aperture to measure a volume distribution and a number distribution of toner of not less than 3 microns. From the result of the volume distribution, a weight-average particle size D4 of the toner is determined.

Further, from the results of Table, it has been clarified that the cleaning performance of the secondary transfer roller becomes better when the surface roughness Rz of the surface layer as the coating layer of the secondary transfer roller satisfies the relationship of: 1.5 microns<Rz<10 microns, preferably 2 microns<Rz<5 microns. As a result, the abrasion of member for the transfer member cleaning apparatus is effectively prevented.

The surface roughness Rz is a ten-point average roughness according to JIS B 0601 and measured by a contact-type surface roughness meter ("Surfcorder SE-3400", mfd. by Kabushiki Kaisha Kosaka Kenkyusho). More specifically, the surface roughness Rz of the surface of the secondary transfer roller is measured under conditions including a feeding speed of 0.05 mm/sec and a measurement length of 2.5 mm.

The cleaning blade is caused to abut against the secondary transfer roller in a direction opposite from the rotation direction of the secondary transfer roller at the abutment angle therebetween of 5-20 degrees, preferably 15-20 degrees, and at the abutment pressure of 15-30 g/cm, preferably 17-23 g/cm. As a result, the maximum cleaning performance of the cleaning blade is exhibited even with respect to the secondary transfer roller which is surface-roughened, and the amount of toner can be stably decreased uniformly to such a level as to corresponding to 1 to 3 toner layers permitting the cleaning by the fur brush disposed downstream of the cleaning blade.

As described above, in the present invention, the intermediary transfer type image forming apparatus in which the cleaning apparatus is provided with respect to the transfer member as the secondary transfer member for transferring the toner image from the intermediary transfer member as the second image bearing member to the transfer member is described as an example. The present invention, however, is applicable also to such a direct transfer type image forming apparatus in which the toner image is directly transferred from the photosensitive member as the first image bearing member to the transfer member by the transfer member such as the transfer roller, and the transfer member is provided with the similar cleaning apparatus having the cleaning blade and the fur brush in combination. In this case, the patch as the control image is formed on the photosensitive member and subjected to cleaning by the cleaning apparatus.

In the present invention, the constitution of the image forming apparatus may be modified variously from that shown in FIG. 1 by changing, e.g., the number of image forming portions, the number of colors, and the kind of the image forming portions. For example, the plurality developing devices may be disposed with respect to one photosensitive member or the present invention is applicable to a monochromatic image forming apparatus. Further, the image forming apparatus of the present invention may be of an electrostatic recording type.

In addition, in the present invention, other factors such as dimensions, materials, shapes, and relative positions of the constituent parts of the image forming apparatus described above are not particularly limited to those described above unless otherwise noted specifically.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 106345/2004 filed Mar. 31, 2004, which is hereby incorporated by reference.

What is claimed is:

1. An image forming apparatus, comprising:

an image bearing member on which a developer image is formed with developer, a transfer member which is a rotatable member and transfers the developer image from said image bearing member onto a transfer material, and a transfer member cleaning apparatus for effecting a cleaning operation for removing developer deposited on said transfer member, wherein said transfer member cleaning apparatus comprises, around said transfer member, a cleaning blade and a rotatable cleaning member which is a rotatable member; and a transfer position at which the developer image is transferred from said image bearing member onto the transfer material, said cleaning blade, and said rotatable cleaning member are disposed in this order from an upstream side to a downstream side in a rotation direction of said transfer member, and wherein during a cleaning operation of said transfer member cleaning apparatus, developer in an amount corresponding to one to three layers thereof passes through between said cleaning blade and said transfer member.

2. An apparatus according to claim 1, wherein during the cleaning operation of said transfer member cleaning apparatus, said cleaning blade leaves the developer in a first amount corresponding to one to three layers of the developer on said transfer member and removes developer in a second amount exceeding the first amount, and thereafter said rotatable cleaning member removes the developer left on said transfer member.

3. An apparatus according to claim 1 or 2, wherein said rotatable cleaning member is a fur brush.

4. An apparatus according to claim 1 or 2, wherein said rotatable cleaning member comprises an electroconductive member and is supplied with a bias voltage of a polarity opposite to that of the developer during the cleaning operation of said transfer member cleaning apparatus.

5. An apparatus according to claim 4, wherein said rotatable cleaning member contacts an electroconductive roller which contacts a blade and is supplied with a bias voltage of a polarity opposite to that of the developer.

6. An apparatus according to claim 5, wherein said rotatable cleaning member is supplied with the bias voltage of a polarity opposite to that of the developer through said electroconductive roller.

7. An apparatus according to claim 1 or 2, wherein said transfer member comprises an elastic member having a surface coating layer which has a surface roughness Rz satisfying 1.5 micron<Rz<10 microns.

8. An apparatus according to claim 1 or 2, wherein said cleaning blade abuts against said transfer member in a direction opposite from the rotation direction of said transfer member at an abutment angle of 5-20 degrees and an abutment pressure of 15-30 g/cm.

9. An apparatus according to claim 1 or 2, wherein the developer has an average particle size of 5-6 microns.

10. An apparatus according to claim 1 or 2, wherein said image bearing member is a second image bearing member onto which the developer image is transferred from a first image bearing member.

* * * * *

UNITED STATES PATENT AND TRADEMARK OFFICE

CERTIFICATE OF CORRECTION

PATENT NO. : 7,251,433 B2
APPLICATION NO. : 11/091454
DATED : July 31, 2007
INVENTOR(S) : Ryuta Ai et al.

It is certified that error appears in the above-identified patent and that said Letters Patent is hereby corrected as shown below:

COLUMN 2:
Line 30, “advantageous” should read --advantageously--.
Line 58, “at the time of contamination and image” should be deleted.
Line 59, “defect” should be deleted.

COLUMN 4:
Line 9, “bake-side” should read --back-side--.
Line 65, “and id;” should read --and 1*d*;--.

COLUMN 5:
Line 17, “as an yellow” should read --as a yellow--.
Line 18, “when reaches” should read --when it reaches--.
Line 29, “an yellow” should read --a yellow--.

COLUMN 6:
Line 38, “INside” should read --inside--.
Line 62, “image. The secondary” should read --image. ¶ The secondary--.

COLUMN 7:
Line 55, “a valves” should read --a value--.

COLUMN 8:
Line 2, “BY” should read --By--.

COLUMN 9:
Line 25, “may desirably has” should read --may desirably have--.
Line 45, “as an electroconductive” should read --is an electronconductive--.
Line 57, “were specifically” should read --more specifically--.

UNITED STATES PATENT AND TRADEMARK OFFICE

CERTIFICATE OF CORRECTION

PATENT NO. : 7,251,433 B2
APPLICATION NO. : 11/091454
DATED : July 31, 2007
INVENTOR(S) : Ryuta Ai et al.

It is certified that error appears in the above-identified patent and that said Letters Patent is hereby corrected as shown below:

COLUMN 10:

Line 49, “determining” should read --determine--.

COLUMN 11:

Line 35, ““YES” represent” should read --“YES represents--.
Line 39, “is (passing” should read --(passing--.
Line 62, “pressure if” should read --pressure is--.
Line 63, “backside” should read --back-side--.

COLUMN 12:

Line 9, “layer” should read --layers--.
Line 29, “which is” should read --which are--.
Line 55, “cut” should read --out--.

COLUMN 13:

Line 19, “Table,” should read --Table 1,--.

Signed and Sealed this

Fifteenth Day of April, 2008

JON W. DUDAS
*Director of the United States Patent and Trademark Office*